US006290616B1

(12) United States Patent
Evans et al.

(10) Patent No.: US 6,290,616 B1
(45) Date of Patent: Sep. 18, 2001

(54) GOLF TEE

(75) Inventors: Peter R. Evans, Ponte Vedra Beach, FL (US); William Tener, Greensboro, NC (US)

(73) Assignee: Dean Tener, Winston Salem, NC (US); a part interest by operation of law from the Estate of William Tener, deceased ( * ) Notice: Subject to any disclaimer, the term of this patent is extended or adjusted under 35 U.S.C. 154(b) by 311 days.

(21) Appl. No.: 08/861,095

(22) Filed: May 21, 1997

(51) Int. Cl.[7] ..... A63B 57/00
(52) U.S. Cl. ..... 473/399
(58) Field of Search ..... 473/399, 387, 473/401, 402, 403, 400, 396

(56) References Cited

U.S. PATENT DOCUMENTS 3,954,263 * 5/1976 Whelan et al. ..... 473/399
4,014,541 * 3/1977 Desmarais ..... 473/399
4,126,438 * 11/1978 Pulli et al. ..... 473/399
5,082,264 * 1/1992 Takeno ..... 473/399
5,085,438 * 2/1992 Takeno ..... 473/399
5,431,392 * 7/1995 Carson et al. ..... 473/399

OTHER PUBLICATIONS

Mang, Michael et al., "Synthesis and Properties of New Biodegradable Polyesters Derived from Diacids and Diglycidyl Ethers", The Dow Chemical Company, pp. 417–418, May 20, 1997.*

* cited by examiner

*Primary Examiner*—Steven Wong
(74) *Attorney, Agent, or Firm*—Harness, Dickey & Pierce, P.L.C.

(57) ABSTRACT

A tee has an earthen body with a binder. The mixture can be injection molded into a tee configuration mold. The tee also has an outer hard shell which is a water soluble polymer. The tees are environmentally friendly and are biodegradable and soluble in water returning the earthen material into the ground.

13 Claims, 1 Drawing Sheet

GOLF TEE

BACKGROUND OF THE INVENTION

The present invention relates to golf equipment and, more particularly, to biodegradable golf tees.

In the game of golf, at the beginning of each hole prior to hitting the ball, the player is allowed to tee his ball so that the ball is elevated above the ground. Current golf tees are made from wood and they are the standard of the sport. The wooden tees are processed, shaped and ordinarily painted. These wooden tees have a long-term effect on the environment since the wood must age and then slowly deteriorate before the wooden tee degrades. Plastic tees have also been used in the past. However, these tees had the drawback of marring the club face when the ball and tee are struck by the player.

The biggest problem with both wooden and plastic tees are the effect they have on maintenance equipment. Since the grass on the tee boxes is ordinarily cut every day, the wooden and plastic tees rained havoc on maintenance grass cutting equipment. This is due to the fact that the cup-shape portion of the tee which breaks off and lands on the tee box, as well as the stem portion of the tee which remains stuck into the ground, must be picked-up by the maintenance people or the tee portions will be cut by the grass cutting equipment. However, as wooden and plastic tees are cut by the lawn equipment, this cutting of the tees has a detrimental effect on the lawn equipment due to the fact that the wooden and plastic tees dull and may chip the cutting blades of the lawn equipment. Thus, it would be desirous to have a golf tee which rapidly degrades or is broken up by the lawn equipment during the grass cutting process.

SUMMARY OF THE INVENTION

The present invention provides the art with a golf tee which rapidly degrades into the earth. The present invention provides the art with a golf tee which is made from an earthen material that upon solubilizing or being crushed by lawn equipment rapidly mixes with the earth. Also, the present invention provides the art with an earthen golf tee which is durable due to its hard shell finish.

From the following detailed description, taken in conjunction with the drawings and subjoined claims, other objects and advantages of the present invention will become apparent to those skilled in the art.

DETAILED DESCRIPTION OF THE PREFERRED EMBODIMENT

Figure 1:
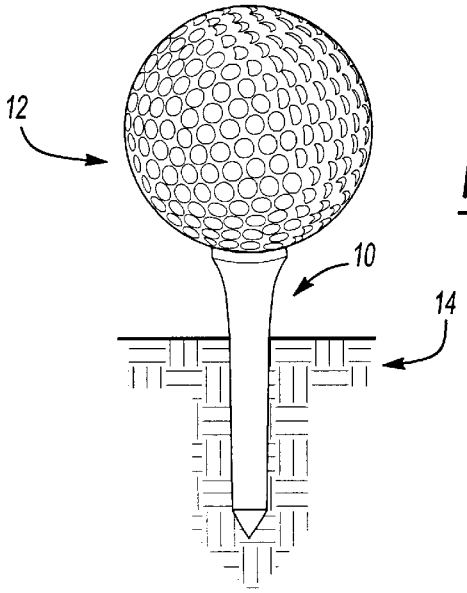
FIG. 1 is a perspective view of a golf tee with a ball.
Figure 2:
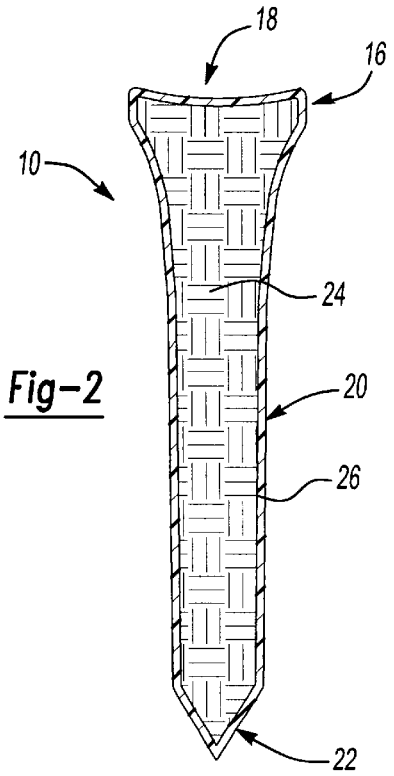
FIG. 2 is a cross-section view through the tee of FIG. 1.

Referring to the Figures, a golf tee in accordance with the present invention is illustrated and designated with the reference numeral 10. A golf ball 12 is sitting on top of the tee which is pressed into the ground 14.

The tee 10 includes an upper or ball holding portion 16 which has an arcuate surface 18 to receive the ball 12. A stem portion 20 extends from the ball holding portion 16 and is pressed into the ground 14. Also, the stem portion 20 includes a tip 22 which is somewhat pointed and sharp to enable the tee to be readily pushed into the ground.

The tee 10 is formed from an earthen material 24 such as silica sand, clay, grass seed, dirt, or a mixture thereof. The earthen material is mixed with a binder such as a sodium silicate cold box binder, which enables the earthen material and binder to have a molten consistency so that the mixture can easily be molded in a die. Types of binders which work well are those that are water-soluble biodegradable and environmentally friendly. Such water-soluble binders are sold under the trade name of Accoset by Ashland Chemical.

The tee includes an outer coating 26 which is a non irradiated water-soluble polymer. The water-soluble polymer has a desired thickness from about 3 mils to 5 mils. This thickness enables the coating to be relatively soft so that the coating does not mar the golf clubs like those of previous plastic tees. A coating which is suitable for this purpose is manufactured by Dow Chemical and is a water soluble polymer.

Figure 3:
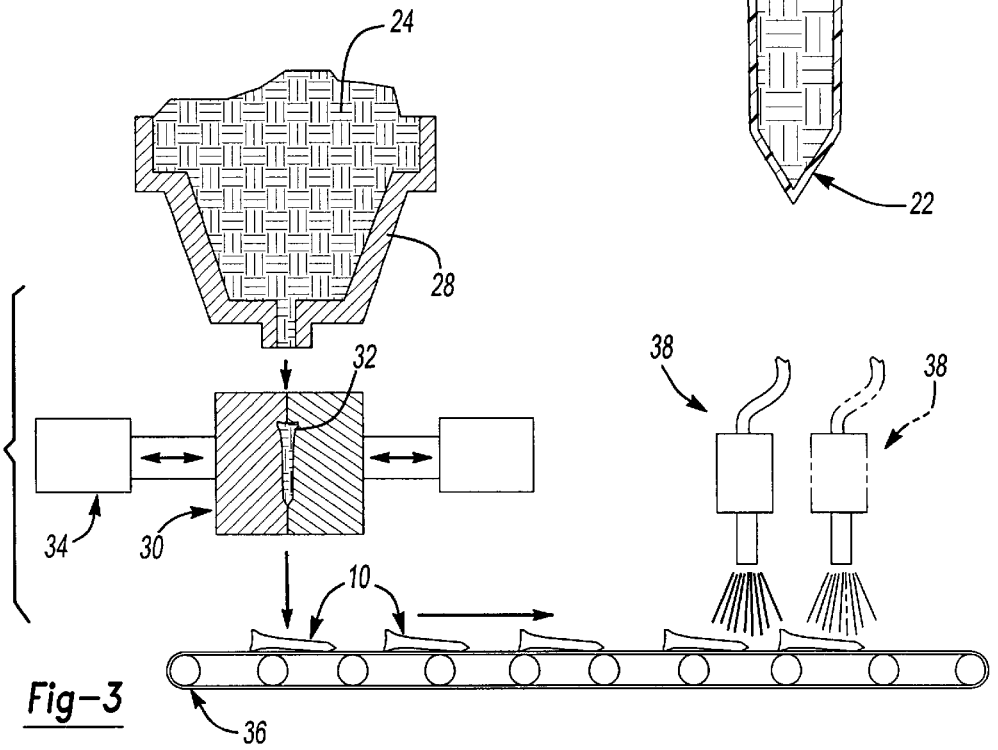
FIG. 3 is a schematic view of the manufacturing of the golf tees of the present invention.

Turning to FIG. 3, a method of forming a tee in accordance with the present invention is disclosed. Ordinarily, the earthen material 24 such as the silica sand or clay is mixed together with a precise amount of the chemical binder in a hopper 28 or the like. The mixed material is then directed from the hopper 28 or the like into a mold 30 which has tee shaped impressions 32. An injection type of molding machine 34 may be utilized to move the mixed material while utilizing high pressures to form the tee in the mold. After the tees are formed in the mold, they are removed and coated with the soluble polymer. This coating process may be achieved by spraying, dipping or the like. As shown, the tees 10 are placed on a conveyor 36 and the coating 26 is sprayed by spray equipment 38. During this process, the desired thickness of the polymer is obtained on the outer surface of the binder and earthen material mix. The tees 10 may then be packed or the like to provide for shipping of the tees to the ultimate consumer.

While eventually the tees will break and a portion of the tee will remain on the ground on the tee box and a portion in the ground in the tee box, both of the parts will dissolve during normal watering through the golf course's sprinkling system or by natural rain. All of the products used in the tee are biodegradable and physically and chemically return to nature and the earth. The maintenance lawn mowers will crush the broken parts of the tees without harming the blades of the mowers. Further, as the tees are crushed or ground, the material will return into the earth and by utilizing a sand/clay mixture, it will return back to the soil faster. Also, if the tee includes a seed, it will enhance the consistency of the tee box as well as return grass quicker to the tee box.

While the above detailed description describes the preferred embodiment of the present invention, the invention is susceptible to modification, variation and alteration without deviating from the scope and fair meaning of the subjoined claims.

What is claimed is:

1. A golf tee comprising:

an earthen material a biodegradable binder material; and a biodegradable soluble polymer coating having a desired thickness.

2. The golf tee according to claim 1, wherein said earthen material is selected from the group comprising clay, sand, silica, dirt, seed or combinations thereof.

3. The golf tee according to claim 1, wherein said binder being a sodium silicate cold box binder.

4. The golf tee according to claim 3, wherein said coating thickness is about 3 mils to about 5 mils.

5. The golf tee according to claim 2, wherein said binder being a sodium silicate cold box binder.

6. The golf tee according to claim 5, wherein said coating being a water soluble polymer.

7. A method of making a golf tee, comprising:

mixing an earthen material with a biodegradable binder;

injection molding said mixed earthen material and binder in a mold;

forming a golf tee;

coating said golf tee with a biodegradable coating to provide a desired thickness coating.

8. The method according to claim 7, wherein said placing of mixed material into a die is by injection molding.

9. The method according to claim 7, wherein said coating is by spraying.

10. The method according to claim 7, wherein said coating is by dipping.

11. The golf tee according to claim 3, wherein said polymer is water-soluble.

12. The golf tee according to claim 3, wherein said polymer is non-toxic.

13. The golf tee according to claim 1, wherein said binder is non-toxic.

* * * * *